US011749886B1

(12) United States Patent
Tabatabai et al.

(10) Patent No.: US 11,749,886 B1
(45) Date of Patent: Sep. 5, 2023

(54) APPARATUS, SYSTEM, AND METHOD FOR PREVENTING RADIO FREQUENCY ENERGY LEAKS AND INTRUSIONS VIA CHOKE STRUCTURES

(71) Applicant: Meta Platforms, Inc., Menlo Park, CA (US)

(72) Inventors: Farbod Tabatabai, San Francisco, CA (US); Srishti Saraswat, Santa Clara, CA (US)

(73) Assignee: Meta Platforms, Inc., Menlo Park, CA (US)

( * ) Notice: Subject to any disclaimer, the term of this patent is extended or adjusted under 35 U.S.C. 154(b) by 205 days.

(21) Appl. No.: 17/393,431

(22) Filed: Aug. 4, 2021

Related U.S. Application Data

(60) Provisional application No. 63/068,234, filed on Aug. 20, 2020.

(51) Int. Cl.

| | |
|---|---|
| ***H01Q 3/10*** | (2006.01) |
| ***H01Q 1/52*** | (2006.01) |
| ***H01Q 21/00*** | (2006.01) |
| ***H01Q 21/06*** | (2006.01) |

(52) U.S. Cl.
CPC ..... *H01Q 3/10* (2013.01); *H01Q 1/52* (2013.01); *H01Q 21/0037* (2013.01); *H01Q 21/06* (2013.01)

(58) Field of Classification Search
CPC .. H01Q 1/52; H01Q 3/02; H01Q 3/08; H01Q 3/10; H01Q 21/0012; H01Q 21/06; H01Q 21/0037
See application file for complete search history.

(56) References Cited

U.S. PATENT DOCUMENTS 6,172,653 B1 * 1/2001 Ohnishi ..... H01Q 3/04 343/882
2019/0089065 A1 * 3/2019 Sikes ..... H01Q 21/005

OTHER PUBLICATIONS

Tang et al., "Apparatus, System, and Method for Transferring Radio Frequency Signals Between Waveguides and Radiating Elements in Antennas", U.S. Appl. No. 17/408,195 dated Aug. 20, 2021, 72 pages.
Tang, Qi, "Apparatus, System, and Method for Implementing Receive and Transmit Antenna Elements in a Single Aperture", U.S. Appl. No. 17/355,888 dated Jun. 23, 2021, 51 pages.
Tang et al., "Apparatus, System, and Method for Transferring Radio Frequency Signals Between Parallel Waveguides in Antennas", U.S. Appl. No. 17/388,237 dated Jul. 29, 2021, 64 pages.
(Continued)

*Primary Examiner* — Robert Karacsony
(74) *Attorney, Agent, or Firm* — Greenberg Traurig, LLP

(57) ABSTRACT

An antenna comprising (1) a bottom RF guide plate rotatably coupled to a base via a first shaft controlled by an azimuth motor, (2) a top array plate rotatably coupled to the base via a second shaft controlled by an elevation motor, the top array plate and the bottom RF guide plate collectively forming a waveguide configured to direct RF signals in a specific direction, and (3) a choke structure coupled to the top array plate, the choke structure and the bottom RF guide plate collectively producing a RF choke that mitigates RF energy leakage or intrusion between the waveguide and an area outside the waveguide. Various other apparatuses, systems, and methods are also disclosed.

20 Claims, 7 Drawing Sheets

(56) References Cited

OTHER PUBLICATIONS

Tabatabai, Farbod, "Apparatus, System, and Method for Transferring Radio Frequency Signals Between Waveguides and Patch Structures in Antennas", U.S. Appl. No. 17/384,297 dated Jul. 23, 2021, 62 pages.
McGuyer et al., "Apparatus, System, and Method for Beam-Steering via Moiré Patterns", U.S. Appl. No. 17/354,864 dated Jun. 22, 2021, 54 pages.
Tabatabai et al., "Apparatus, System, and Method for Facilitating Satellite Handover via Hybrid Antenna Structures", U.S. Appl. No. 17/354,868 dated Jun. 22, 2021, 54 pages.

* cited by examiner

APPARATUS, SYSTEM, AND METHOD FOR PREVENTING RADIO FREQUENCY ENERGY LEAKS AND INTRUSIONS VIA CHOKE STRUCTURES

INCORPORATION BY REFERENCE

This application claims the benefit of U.S. Provisional Application No. 63/068,234, filed on Aug. 20, 2020, the disclosure of which is incorporated, in its entirety, by this reference.

BRIEF DESCRIPTION OF DRAWINGS

The accompanying drawings illustrate a number of exemplary embodiments and are a part of the specification. Together with the following description, these drawings demonstrate and explain various principles of the present disclosure.

Figure 1:
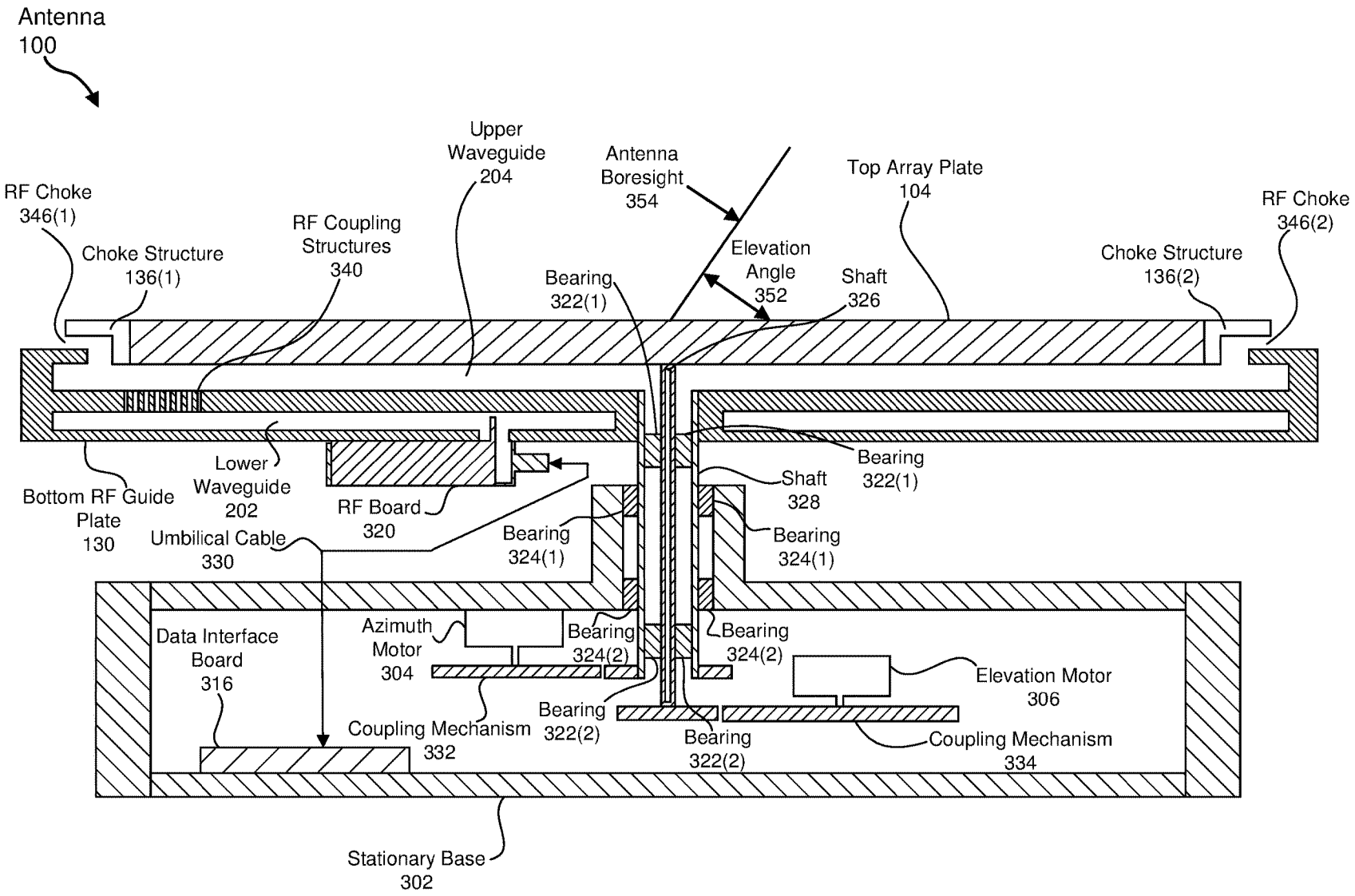
FIG. 1 is an illustration of an exemplary antenna that includes parallel waveguides in accordance with one or more embodiments of this disclosure.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the present disclosure covers all modifications, equivalents, and alternatives falling within this disclosure.

DETAILED DESCRIPTION OF EXEMPLARY EMBODIMENTS

The present disclosure is generally directed to apparatuses, systems, and methods for preventing RF energy leaks and/or intrusions via choke structures. As will be explained in greater detail below, these apparatuses, systems, and methods may provide numerous features and benefits. In some antenna systems with RF waveguides for directing RF signals, one or more RF chokes may be employed to suppress and/or eliminate an RF signal (e.g., over at least some bandwidth). This suppression and/or elimination of the RF signal may prevent unwanted RF signal intrusion into and/or leakage out of a particular portion of the antenna systems. For example, some antenna systems may include and/or incorporate a waveguide within which RF signals traverse. In this example, the waveguide may include and/or incorporate a terminating end at which an RF choke is applied and/or employed to prevent RF signals from substantially escaping and/or leaking from the terminating end.

In some examples, a mechanically steerable antenna (MSA) may include and/or represent a branched RF choke structure applied and/or employed near opposing ends of a waveguide. However, other types of antenna systems and/or RF waveguide systems may benefit from the application of the various embodiments of branched RF choke structures described. In some examples, the branched RF choke structures may provide significant isolation between an operational portion of a waveguide and a non-operational portion of the waveguide. Such RF choke structures may reduce power leakage to increase the power efficiency of the waveguide and the overall antenna system.

The following will provide, with reference to FIGS. 1-6, detailed descriptions of exemplary apparatuses, systems, components, and structures for preventing RF energy leaks and/or intrusions via choke structures. In addition, detailed descriptions of exemplary methods for preventing RF energy leaks and/or intrusions via choke structures will be provided in connection with FIG. 7.

FIG. 1 illustrates a side cross-section of an exemplary low-profile steerable antenna 100 that incorporates and/or employs an RF board 320 for transmitting and/or receiving RF signals in connection with a lower waveguide 202 and an upper waveguide 204. In some examples, exemplary low-profile steerable antenna 100 may facilitate and/or support exchanging communications with remote antennas via a constellation of satellites. As illustrated in FIG. 1, exemplary steerable antenna 100 may each include and/or represent a stationary base 302, an azimuth motor 304, an elevation motor 306, a bottom RF guide plate 130, and a top array plate 104. In some examples, azimuth motor 304 may be fixably coupled and/or attached to stationary base 302, and elevation motor 306 may also be fixably coupled and/or attached to stationary base 302. Additionally or alternatively, bottom RF guide plate 130 may be rotatably coupled to stationary base 302 via a shaft 328, and top array plate 104 may be rotatably coupled to stationary base 302 via a shaft 326.

In some examples, azimuth motor 304 may control and/or direct the rotation and/or orientation of shaft 328 and/or bottom RF guide plate 130. For example, azimuth motor 304 may move and/or rotate bottom RF guide plate 130 about or around shaft 328. In this example, shaft 328 may establish and/or provide a fixed axis for rotational movement of bottom RF guide plate 130.

Additionally or alternatively, elevation motor 306 may control and/or direct the rotation and/or orientation of shaft 326 and/or top array plate 104. For example, elevation motor 306 may move and/or rotate top array plate 104 about or around shaft 326. In this example, shaft 326 may establish and/or provide a fixed axis for rotational movement of top array plate 104.

In some examples, top array plate 104 and bottom RF guide plate 130 may collectively form, establish, and/or create upper waveguide 204, which is configured to direct RF signals in a specific direction. In one example, with reference to FIG. 1, RF board 320 may launch an RF signal into lower waveguide 202 of bottom RF guide plate 130. In this example, the RF signal may traverse and/or travel from RF board 320 to the left in FIG. 1 toward RF coupling structures 340. The RF signal may pass from lower waveguide 202 through RF coupling structures 340 to upper waveguide 204. Upon reaching upper waveguide 204, the RF signal may traverse and/or travel within upper waveguide 204 in the opposite direction back toward shaft 326.

As illustrated in FIG. 1, azimuth motor 304 may interface directly with shaft 328 via a coupling mechanism 332, and elevation motor 306 may interface directly with shaft 326 via a coupling mechanism 334. In one example, coupling mechanism 332 may include and/or represent a gear, pulley, or belt system that enables azimuth motor 304 to control and/or rotate shaft 328. By doing so, azimuth motor 304 may be able to control and/or rotate bottom RF guide plate 130 to a specific orientation and/or position. Similarly, coupling mechanism 334 may include and/or represent a gear, pulley, or belt system that enables elevation motor 306 to control and/or rotate shaft 326. By doing so, elevation motor 306 may be able to control and/or rotate top array plate 104 to a specific orientation and/or position.

In some examples, shaft 328 may be hollow and/or form a hole or passage designed to accommodate shaft 326. For example, shaft 326 may rotatably couple top array plate 104 to stationary base 302 by passing though the hollow region, hole, and/or passage of shaft 328. In this example, shaft 328 may rotatably couple bottom RF guide plate 130 to stationary base 302 despite shaft 326 being located and/or positioned inside the hollow region, hole, and/or passage of shaft 328.

In some examples, shaft 326 and/or shaft 328 may be co-centered with respect to the MSA, stationary base 302, top array plate 104, and/or bottom RF guide plate 130. In one example, shaft 326 and/or shaft 328 may provide, facilitate, and/or support low-friction spinning and/or rotation of top array plate 104 and/or bottom RF guide plate 130 around a fixed axis. Additionally or alternatively, shaft 326 and/or shaft 328 may provide, facilitate, and/or support a low moment of inertia for top array plate 104 and/or bottom RF guide plate 130. Such features may enable the MSA to achieve high-speed handover from one satellite to another satellite.

In some examples, stationary base 302 may include and/or represent any type or form of structure, housing, and/or footing capable of supporting top array plate 104 and/or bottom RF guide plate 130. Accordingly, stationary base 302 may maintain and/or secure shafts 326 and 328 about which top array plate 104 and bottom RF guide plate 130, respectively, rotate.

Stationary base 302 may be of various shapes and/or dimensions. In some examples, base 302 may be circular and/or cylindrical. Additional examples of shapes formed by base 302 include, without limitation, ovoids, cubes, cuboids, spheres, spheroids, cones, prisms, variations or combinations of one or more of the same, and/or any other suitable shapes.

Stationary base 302 may be sized in a particular way to house and/or stabilize rotating co-axial plates and/or disks. Stationary base 302 may include and/or contain any of a variety of materials. Examples of such materials include, without limitation, metals, plastics, ceramics, polymers, composites, rubbers, variations or combinations of one or more of the same, and/or any other suitable materials.

In some examples, azimuth motor 304 and/or elevation motor 306 may each include and/or represent any type or form of motor capable of controlling and/or rotating top array plate 104 and/or bottom RF guide plate 130, respectively. In one example, azimuth motor 304 and/or elevation motor 306 may each include and/or represent a stepper motor. Additional examples of azimuth motor 304 and/or elevation motor 306 include, without limitation, servomotors, direct current (DC) motors, alternating current (AC) motors, variations or combinations of one or more of the same, and/or any other suitable motors.

Azimuth motor 304 and/or elevation motor 306 may be of various shapes and/or dimensions. In one example, azimuth motor 304 and/or elevation motor 306 may each be shaped as a cylinder. In another example, azimuth motor 304 and/or elevation motor 306 may each be shaped as a cube or cuboid.

Azimuth motor 304 and/or elevation motor 306 may be sized in a particular way to fit within an MSA. Azimuth motor 304 and/or elevation motor 306 may include and/or contain any of a variety of materials. Examples of such materials include, without limitation, metals, plastics, ceramics, polymers, composites, rubbers, variations or combinations of one or more of the same, and/or any other suitable materials.

In some examples, top array plate 104 and/or bottom RF guide plate 130 may each include and/or represent any type of form of plate and/or disk capable of transmitting and/or receiving RF communications. Top array plate 104 and/or bottom RF guide plate 130 may each be of various shapes and/or dimensions. In one example, top array plate 104 and/or bottom RF guide plate 130 may each be shaped as a disk and/or circle. Additional examples of shapes formed by top array plate 104 and/or bottom RF guide plate 130 include, without limitation, squares, rectangles, triangles, pentagons, hexagons, octagons, ovals, diamonds, parallelograms, variations or combinations of one or more of the same, and/or any other suitable shapes.

Top array plate 104 and/or bottom RF guide plate 130 may be sized in a particular way to fit within an MSA. Top array plate 104 and/or bottom RF guide plate 130 may include and/or contain any of a variety of materials. Examples of such materials include, without limitation, metals, coppers, aluminums, steels, stainless steels, silver, variations or combinations of one or more of the same, and/or any other suitable materials.

In some examples, exemplary antenna 100 may include and/or incorporate bearing 324(1) and/or bearing 324(2) applied between shaft 326 and shaft 328. In one example, bearings 324(1) and 324(2) may provide, facilitate, and/or support free rotational movement for top array plate 104 and/or bottom RF guide plate 130 around a fixed axis. In this example, bearings 324(1) and 324(2) may be attached and/or fitted around the exterior of shaft 326. Additionally or alternatively, bearings 324(1) and 324(2) may be attached and/or fitted inside the hollow region, hole, and/or passage of shaft 328.

Additionally or alternatively, exemplary antenna 100 may include and/or incorporate bearing 322(1) and/or bearing 322(2) applied between shaft 328 and stationary base 302. In one example, bearings 322(1) and 322(2) may provide, facilitate, and/or support free rotational movement for bottom RF guide plate 130 around a fixed axis. In this example, bearings 322(1) and 322(2) may be attached and/or fitted around the exterior of shaft 328. Additionally or alternatively, bearings 322(1) and 322(2) may be attached and/or fitted inside a flange, ridge, and/or lip of stationary base 302. Examples of bearings 324(1), 324(2), 322(1), and 322(2) include, without limitation, ball bearings, roller bearings, plain bearings, jewel bearings, fluid bearings, magnetic bearings, flexure bearings, variations or combinations of one or more of the same, and/or any other suitable type of bearings.

In some examples, bearings 324(1) and 324(2) may maintain and/or support top array plate 104 and/or bottom RF guide plate 130 in a certain position relative to one another within the MSA. In such examples, bearings 324(1) and 324(2) may rotate top array plate 104 and/or bottom RF guide plate 130 relative to stationary base 302. Additionally or alternatively, bearings 322(1) and 322(2) may maintain and/or support bottom RF guide plate 130 in a certain position relative to stationary base 302. In these examples, bearings 322(1) and 322(2) may rotate bottom RF guide plate 130 relative to stationary base 302.

In some examples, exemplary steerable antenna 100 may include and/or incorporate RF board 320 coupled and/or attached to bottom RF guide plate 130. In one example, RF board 320 may generate and/or produce an RF signal for transmission to an overhead satellite. In this example, bottom RF guide plate 130 may form and/or incorporate a waveguide that directs the RF signal toward one or more slots and/or other RF coupling structures that facilitate and/or support the transmission to the overhead satellite. As illustrated in FIG. 1, exemplary steerable antenna 100 may provide a lower waveguide 202 that directs an RF signal generated by RF board 320 toward RF coupling structures 340, which facilitate and/or support the transmission of the RF signal.

In some examples, exemplary steerable antenna 100 may include and/or incorporate a data interface board 316 coupled and/or attached to stationary base 302. In one example, data interface board 316 may feed and/or source intermediate frequency data to RF board 320 via an umbilical cable 330. In this example, RF board 320 may then convert and/or integrate intermediate frequency data into the RF signal transmitted to the overhead satellite.

In some examples, data interface board 316 and/or RF board 320 may include and/or contain one or more processing devices and/or memory devices. Such processing devices may each include and/or represent any type or form of hardware-implemented processing device capable of interpreting and/or executing computer-readable instructions. In one example, such processing devices may access and/or modify certain software modules, applications, and/or data stored in the memory devices. Examples of such processing devices include, without limitation, physical processors, central processing units (CPUs), microprocessors, microcontrollers, Field-Programmable Gate Arrays (FPGAs) that implement softcore processors, Application-Specific Integrated Circuits (ASICs), Systems on a Chip (SoCs), portions of one or more of the same, variations or combinations of one or more of the same, and/or any other suitable processing devices.

Such memory devices may each include and/or represent any type or form of volatile or non-volatile storage device or medium capable of storing data, computer-readable instructions, software modules, applications, and/or operating systems. Examples of such memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, and/or any other suitable storage memory devices. In some examples, certain processing devices and memory devices may be considered and/or viewed as a single device and/or unit.

In some examples, data interface board 316 may provide intermediate frequency data by way of an umbilical cable to RF board 320, which modulates an RF reference wave to generate the RF signals that are subsequently fed to the lower cavity and/or lower waveguide 202 by an RF feed structure (e.g., pins, slots, and/or other RF coupling structures). In some examples, the RF feed structure and/or board may be fixably coupled to an outer surface (e.g., an underside) of the bottom RF guide plate. Some embodiments of the feed or launch structure are described in greater detail below in connection with FIGS. 2 and 3.

In some examples, top array plate 104 may include and/or incorporate choke structures 136(1) and 136(2) that, together with bottom RF guide plate 130, form RF chokes 346(1) and 346(2), respectively. For example, choke structures 136(1) and 136(2) may be coupled to top array plate 104 such that these choke structures and bottom RF guide plate 130 collectively produce RF chokes 346(1) and 346(2). In this example, RF chokes 346(1) and 346(2) may prevent and/or mitigate RF energy leakage or intrusion between upper waveguide 204 and the area outside upper waveguide 204.

In some examples, choke structures 136(1) and 136(2) may each include and/or represent any type or form of structure and/or feature that, in conjunction with bottom RF guide plate 130, is capable of rejecting and/or blocking RF signals. Choke structures 136(1) and 136(2) may take any of various forms, shapes, designs, and/or dimensions. In one example, one or more of choke structures 136(1) and 136(2) may include and/or constitute an L-shaped choke structure. In another example, one or more of choke structures 136(1) and 136(2) may include and/or constitute a T-shaped choke structure. In a further example, one or more of choke structures 136(1) and 136(2) may include and/or constitute a plus-shaped and/or cross-shaped choke structure. In an additional example, one or more of choke structures 136(1) and 136(2) may include and/or constitute a stacked T-shaped choke structure. In an alternative example, one or more of choke structures 136(1) and 136(2) may include and/or constitute an F-shaped choke structure.

Further regarding antenna 100 in FIG. 1, choke structures 136(1) and 136(2) may be employed at a gap between the PCB array holding clamp (e.g., a clamp that retains the top array plate) and the bottom RF guide plate. In some embodiments, the gap may be provided to facilitate relative rotation between the top array plate and the bottom RF guide plate to facilitate changes in the azimuth and elevation angles of the antenna boresight. In one embodiment, this gap (e.g., in isolation or with other structures) may be shaped as a branched RF choke structure to provide isolation and/or prevent RF energy leakage between the upper cavity and areas outside the upper cavity via the gap.

In some examples, choke structures 136(1) and 136(2) may be dimensioned for isolation performance over at least some portion of the $K_u$ band (e.g., from approximately 10.70 gigahertz (GHz) to about 14.50 GHz, which may be employed in antenna 100 in FIG. 1 to transmit and/or receive RF signals). However, other examples may employ different physical dimensions for choke structures 136(1) and 136(2) to provide isolation over different RF bands.

In some examples, the term "branched" may generally refer to a choke structure that changes directions transverse to a direction of propagation of RF energy within a waveguide to which the choke structure is coupled. In one example, a rectangular waveguide may be applied with opposing RF choke structures at each end. However, each choke structure may also be implemented with other waveguides, such as the upper cavity of antenna 100 in FIG. 1.

In some examples, choke structures 136(1) and 136(2) may provide isolation (e.g., an RF "open circuit") at diametrically opposing sides of bottom RF guide plate 130 at the gap between the PCB array holding clamp (e.g., that retains top array plate 104) and bottom RF guide plate 130—with the rectangular waveguide modeling a portion of the upper cavity extending between the RF choke structures and passing through the center of the upper cavity. Consequently, in some embodiments, the opposing RF choke structures may represent much wider nonlinear structures formed along opposing sides of circular bottom RF guide plate 130 and top array plate 104. In some examples, the use of choke structures in such an environment may result in a maximized amount of RF signal energy present between the choke structures and a minimized amount of RF signal energy present outside the choke structures (e.g., external to the upper cavity).

Choke structures 136(1) and 136(2) may each include and/or represent any of various materials. In one example, choke structures 136(1) and 136(2) may include and/or contain one or more metals (e.g., aluminums). Examples of such materials include, without limitation, coppers, golds, steels, alloys, silvers, nickels, brass, silicon, glasses, polymers, variations or combinations of one or more of the same, and/or any other suitable materials.

In some examples, choke structures 136(1) and 136(2) may each be of any suitable shape and/or dimensions. In one example, choke structures 136(1) and 136(2) may be sized in a particular way to prevent the escape and/or intrusion of RF signals via the opening between top array plate 104 and/or bottom RF guide plate 130. For example, one dimension (e.g., a length) of choke structures 136(1) and 136(2) may be substantially equal to a quarter wavelength of the RF signals multiplied by an odd number (e.g., 1).

In some examples, top array plate 104 and/or bottom RF guide plate 130 may be positioned and/or oriented in certain ways to steer, direct, and/or aim a boresight (e.g., the axis of maximum gain of the antenna) in different directions. These positions and/or orientations of top array plate 104 and bottom RF guide plate 130 may be achieved for purposes of tracking an overhead satellite and/or switching between satellites.

In some examples, top array plate 104 and/or bottom RF guide plate 130 may include and/or represent various antennae elements, features, and/or tiles combined and/or configured as a single unit. In one example, the single unit may constitute and/or represent a directional antenna system capable of beamforming and/or spatial filtering in connection with transmitting and/or receiving communications.

In some embodiments, the top array plate may be 350-to-450 millimeters (mm) in diameter, and the bottom RF guide plate may be 345-to-445 mm in diameter. However, other sizes for the top array plate and the bottom RF guide plate may also be employed. In one example, a total height for the antenna, including the stationary base, may be approximately 100-to-120 mm, resulting in a low-profile antenna arrangement.

While the component of the steerable antenna to which the bottom RF guide plate and the top array plate are coupled is termed a "stationary base", such a base may be fixably coupled to the ground or to a movable platform (e.g., an airborne or ground-based vehicle). In either case, the stationary base may provide a reference frame within which the bottom RF guide plate and the top array plate may be oriented to provide connectivity to a satellite.

In some examples, the bottom RF guide plate and the top array plate may form RF cavities or waveguides that facilitate the transmission and/or reception of RF signals. More specifically, in some examples, the bottom RF guide plate may define and/or form a lower cavity. In addition, the lower cavity may connect to and/or be equipped with one or more openings or other features that form part of a feed and/or launch structure for introducing an RF signal into the lower cavity for transmission to a satellite by the antenna and/or for receiving an RF signal from a satellite by the antenna via the lower cavity. While one RF feed is depicted in FIG. 1, multiple RF feeds and associated circuitry may be employed in other embodiments.

In some examples, one or more coupling structures (e.g., one or more slots in the bottom RF guide plate, possibly in combination with other components and/or materials, such as metal patches, dielectric materials, and/or the like) may couple the lower cavity with an upper cavity defined by the combination of the bottom RF guide plate and the top array plate. For example, RF coupling structures 340 may effectively couple lower waveguide 202 and upper waveguide 204 together such that RF signals launched by RF board 320 are able to traverse from lower waveguide 202 to upper waveguide 204 via RF coupling structures 340. Additionally or alternatively, RF coupling structures 340 may effectively couple lower waveguide 202 and upper waveguide 204 together such that RF signals received by antenna 100 are able to traverse from upper waveguide 204 to lower waveguide 202 via RF coupling structures 340.

In some examples, the top array plate may include a holding clamp at a perimeter about the top array plate for holding a printed circuit board (PCB). In one example, the PCB may include and/or incorporate an array of antenna array elements (e.g., patch antenna elements, spiral antenna array elements, and/or the like) positioned for transmission and/or reception of RF signals between the antenna and the satellite. In this example, an edge region of the top array plate and the bottom RF guide plate may form a waveguide choke flange and associated slot (or other such RF coupling structures) that substantially restrict leakage of RF energy over an operating range of frequencies of the RF signals being transmitted and received by the antenna. The choke flange and/or slot may thus form a contactless interface between the top array plate and the bottom RF guide plate to facilitate relative changes in orientation between the two plates.

In operation, for transmitting RF signals from the antenna (e.g., to a satellite), an RF feed and/or launch structure may introduce the RF signal into the lower cavity for propagation within the lower cavity (e.g., as a transverse electric mode signal). In response to the coupling structures of the bottom RF guide plate, the RF signal in the lower cavity may traverse into the upper cavity (e.g., as a transverse electromagnetic mode signal). In some embodiments, the resulting RF signal may be directed along a particular direction determined by the orientation of the bottom RF guide plate based at least in part on the arrangement, location, and/or orientation of the coupling structures as well as the RF feed into the lower cavity. Moreover, the RF signal in the upper cavity may interact with the elements of the antenna array that facilitate transmitting the RF signal to the satellite. In at least one example, antenna 100 may exhibit and/or control an elevation angle 352 of an antenna boresight 354 (the axis along which the RF signal is transmitted). In this example, elevation angle 352 of antenna boresight 354 may be determined by the alignment of the array elements relative to the direction along which the RF signal in the upper cavity is aligned.

In the embodiments described above, the orientation of the bottom RF guide plate (e.g., due to the positioning and/or alignment of the RF feed and/or the coupling structure) and the top array plate (e.g., due to the arrangement and/or structure of the element array) may determine and/or control the orientation (azimuth and elevation) of antenna boresight 354 along which the RF signal is transmitted. In some examples, the same change in the orientation of both the bottom RF guide plate and the top array plate may result in the same change in the azimuth angle of antenna boresight 354 without a change in the elevation angle of antenna boresight 354. In those examples, a change in the orientation of the top array plate without a change in orientation of the bottom RF guide plate may result in a change of the same amount of elevation of antenna boresight 354. Additionally, in some embodiments, such a change in orientation of the top array plate alone may result in a change in orientation of azimuth of the antenna boresight (e.g., by half the amount of the change in orientation of the elevation of the antenna boresight).

In operating the antenna to receive an RF signal (e.g., from the satellite aligned with the antenna boresight), excitation of elements of the antenna array in response to the received signal may cause an RF signal (e.g., a transverse electromagnetic mode signal) to propagate within the upper cavity. In some examples, the array elements being excited by the received RF signal (e.g., receiving elements) may be different from the array elements responsible for transmitting an RF signal to the satellite (e.g., transmitting elements). Further, in some embodiments, the receiving elements and the transmitting elements may be interspersed such that they occupy the same antenna aperture, as defined by the top array plate.

Further, the RF signal propagating within the upper cavity may be coupled into the lower cavity by the one or more coupling structures of the bottom RF guide plate, resulting in an RF signal (e.g., a transverse electric mode signal) propagating in the lower cavity, which may be sensed by the RF board via the RF feed, launch structure, and/or additional components. The RF board may demodulate and/or convert the sensed signal into an intermediate frequency signal that is processed further via data interface board 316.

While embodiments of the antenna, as described herein, generally presume their use for communication with low Earth orbit (LEO) satellites, communication with medium Earth orbit (MEO) satellites, communication with satellites in other orbits, and communication with other devices (e.g., aircraft) may also benefit from the various examples discussed herein.

In FIG. 1, RF board 320 may implement and/or employ a patch-fed structure for launching and/or receiving RF signals. For example, a patch structure of RF board 320 may launch an RF signal into lower waveguide 202 and/or receive an RF signal from lower waveguide 202. In particular, the lower cavity that serves as the waveguide may be substantially circular in one dimension and/or may possess a substantially constant height in another dimension. Also, while antenna 100 in FIG. 1 depicts a single RF feed structure for launching the RF signal into the lower cavity, two or more such feed structures (e.g., two or more patch structures, as described below) may be employed in some embodiments of antenna 100.

In some examples, lower waveguide 202 may include and/or contain a reflector designed to reflect and/or bounce RF signals back in the opposite direction. Additionally or alternatively, upper waveguide 204 may include and/or contain another reflector designed to reflect and/or bounce RF signals back in the opposite direction. For example, some RF signals traversing and/or travelling through lower waveguide 202 or upper waveguide 204 in the leftward direction in FIG. 1 may reach the reflector. In this example, such RF signals may be reflected and/or bounced back in the rightward direction in FIG. 1 by the reflector. In one embodiment, the reflector may be applied to an end of lower waveguide 202 and/or upper waveguide 204 positioned proximate to RF coupling structures 340.

In some examples, lower waveguide 202 may be configured and/or designed to direct certain RF signals in a specific direction, and upper waveguide 204 may be configured and/or designed to direct such RF signals in the opposite direction. For example, lower waveguide 202 may be configured and/or designed to direct RF signals being transmitted by antenna 100 in the leftward direction in FIG. 1 toward RF coupling structures 340. In contrast, upper waveguide 204 may be configured and/or designed to direct such RF signals being transmitted by antenna 100 in the rightward direction in FIG. 1 away from RF coupling structures 340.

Similarly, upper waveguide 204 may be configured and/or designed to direct RF signals received by antenna 100 in the leftward direction in FIG. 1 toward RF coupling structures 340. In contrast, lower waveguide 202 may be configured and/or designed to direct such RF signals received by antenna 100 in the rightward direction in FIG. 1 away from RF coupling structures 340.

In some examples, lower waveguide 202 and/or upper waveguide 204 may each include and/or represent any type or form of structure and/or feature capable of guiding and/or directing RF signals. In one example, lower waveguide 202 and/or upper waveguide 204 may each include and/or represent a hollow metallic pipe and/or disk that carries radio waves in one direction and/or another. In this example, lower waveguide 202 and/or upper waveguide 204 may each serve and/or function as a transmission line. Accordingly, lower waveguide 202 and/or upper waveguide 204 may each constitute a link in the transmission path of RF signals sent from and/or received by antenna 100.

Lower waveguide 202 and/or upper waveguide 204 may each include and/or represent any of various materials. Examples of such materials include, without limitation, coppers, golds, steels, alloys, silvers, nickels, brass, aluminums, silicon, glasses, polymers, variations or combinations of one or more of the same, and/or any other suitable materials.

In some examples, lower waveguide 202 and/or upper waveguide 204 may each be of any suitable shape and/or dimensions. In one example, lower waveguide 202 and/or upper waveguide 204 may include and/or form a hollow cylinder and/or cuboid. Accordingly, lower waveguide 202 and/or upper waveguide 204 may maintain a cylindrical and/or rectangular shape that extends across certain parts of the corresponding antenna system. Additional examples of shapes formed by lower waveguide 202 and/or upper waveguide 204 include, without limitation, ovoids, cubes, cuboids, spheres, spheroids, cones, prisms, variations or combinations of one or more of the same, and/or any other suitable shapes.

Figure 2:
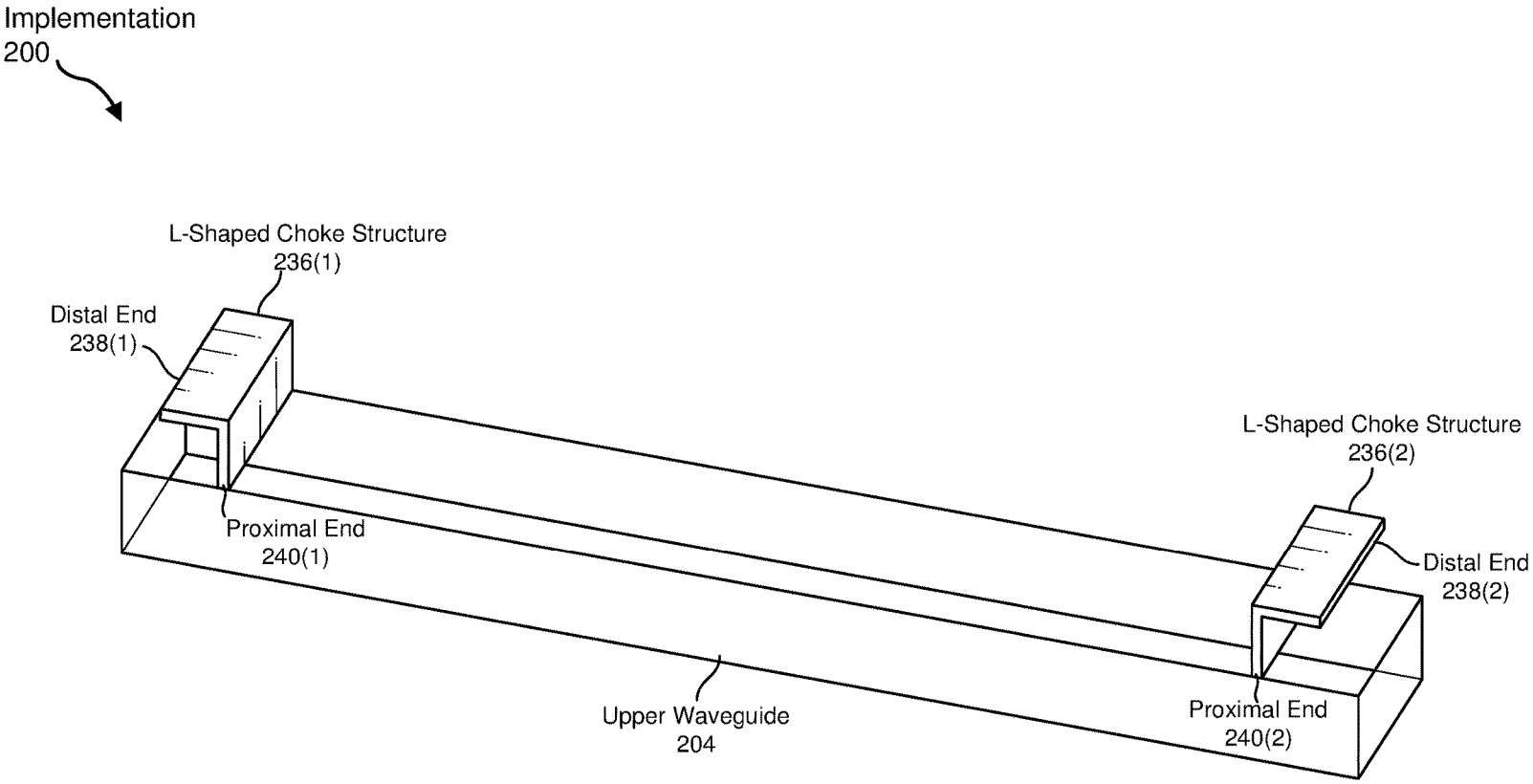
FIG. 2 is an illustration of an exemplary implementation for preventing radio frequency (RF) energy leaks and intrusions in accordance with one or more embodiments of this disclosure.

FIG. 2 illustrates an exemplary implementation 200 that facilitates preventing RF energy leaks and/or intrusions via choke structures. As illustrated in FIG. 2, exemplary implementation 200 may include and/or involve L-shaped choke structures 236(1) and 236(2). In some examples, L-shaped choke structures 236(1) and 236(2) may be coupled and/or attached to top array plate 104 such that L-shaped choke structures 236(1) and 236(2) are positioned against and/or aligned with upper waveguide 204. In one example, L-shaped choke structure 236(1) may include and/or represent a distal end 238(1) and a proximal end 240(1) that are fixed to form a 90-degree angle. Additionally or alternatively, L-shaped choke structure 236(2) may include and/or represent a distal end 238(2) and a proximal end 240(2) that are fixed to form a 90-degree angle.

In one example, proximal end 240(1) of L-shaped choke structure 236(1) may interface with and/or be positioned against or proximate to one side of upper waveguide 204. Similarly, proximal end 240(2) of L-shaped choke structure 236(2) may interface with and/or be positioned against the opposing side of upper waveguide 204.

In one example, distal end 238(1) of L-shaped choke structure 236(1) may remain and/or be positioned away or distal from one side of upper waveguide 204. Similarly, distal end 238(2) of L-shaped choke structure 236(2) may remain and/or be positioned away or distal from the opposing side of upper waveguide 204.

In one example, the lengths of L-shaped choke structures 236(1) and 236(2) may each be substantially equal to a quarter wavelength of the RF signals multiplied by an odd number. For example, if antenna 100 in FIG. 1 transmits and/or receives 10-Ghz signals, the length of L-shaped choke structure 236(1) may measure 7.5 mm from distal end 238(1) to proximal end 240(1). In another example, if antenna 100 in FIG. 1 transmits and/or receives 20-Ghz signals, the length of L-shaped choke structure 236(2) may measure 3.7 mm from distal end 238(2) to proximal end 240(2).

In some examples, one or more of distal ends 238(1) and 238(2) may be enclosed with a metallic wall and/or side. In other examples, one or more of distal ends 238(1) and 238(2) may be open without any walls and/or sides. In one example, L-shaped choke structures 236(1) and 236(2) may serve as the gap between the PCB array holding clamp and the bottom RF guide plate of antenna 100 in FIG. 1.

Figure 3:
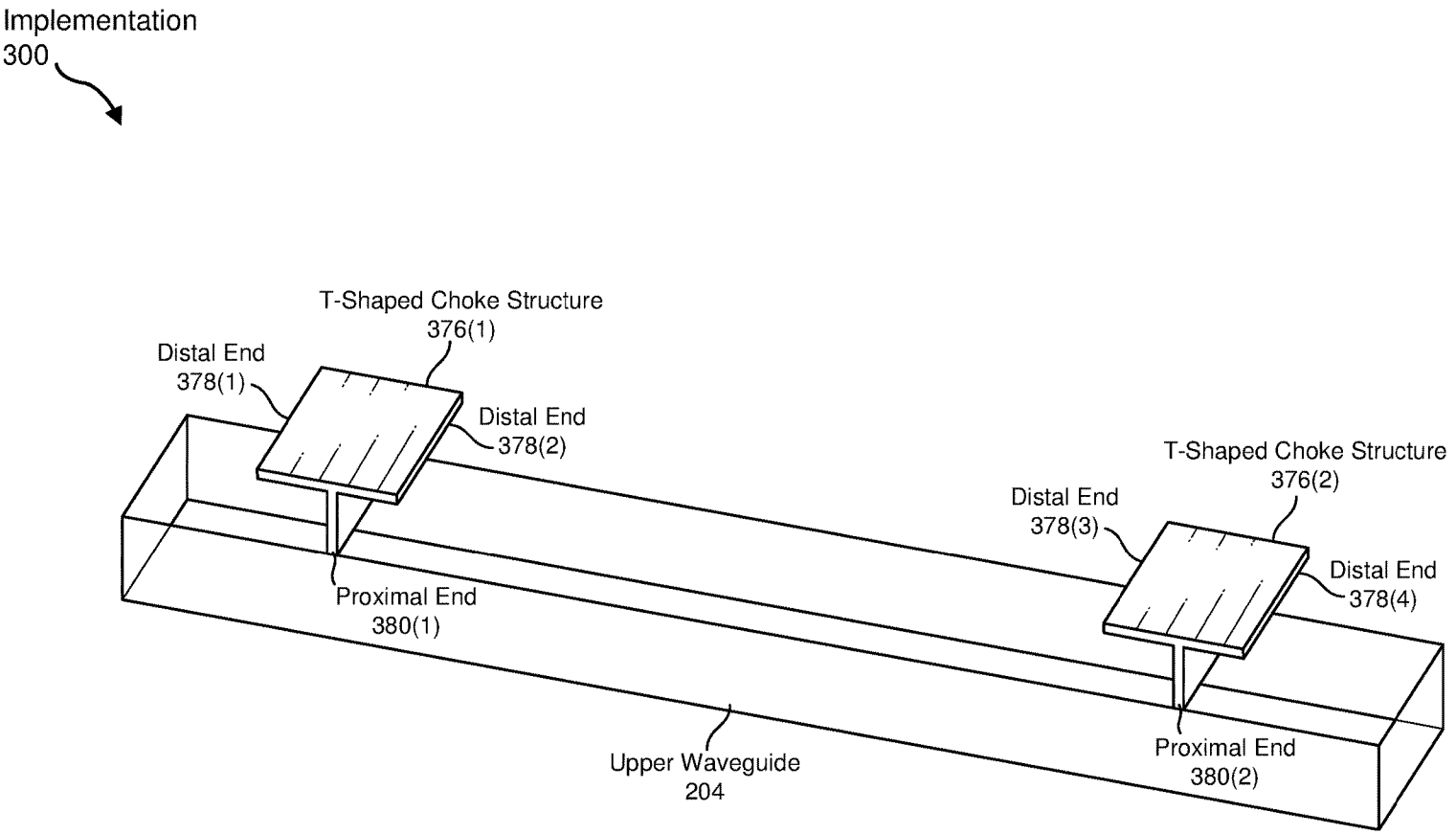
FIG. 3 is an illustration of an additional exemplary implementation for preventing RF energy leaks and intrusions via choke structures in accordance with one or more embodiments of this disclosure.

FIG. 3 illustrates an exemplary implementation 300 that facilitates preventing RF energy leaks and/or intrusions via choke structures. As illustrated in FIG. 3, exemplary implementation 300 may include and/or involve T-shaped choke structures 376(1) and 376(2). In some examples, T-shaped choke structures 376(1) and 376(2) may be coupled and/or attached to top array plate 104 such that T-shaped choke structures 376(1) and 376(2) are positioned against and/or aligned with upper waveguide 204. In one example, T-shaped choke structure 376(1) may include and/or represent a proximal end 380(1) fixed orthogonally between distal ends 378(1) and 378(2) such that proximal end 380(1) forms 90-degree angles with both of distal ends 378(1) and 378(2). Additionally or alternatively, T-shaped choke structure 376(2) may include and/or represent a proximal end 380(2) fixed orthogonally between distal ends 378(3) and 378(4) such that proximal end 380(2) forms 90-degree angles with both of distal ends 378(3) and 378(4).

In one example, proximal end 380(1) of T-shaped choke structure 376(1) may interface with and/or be positioned against or proximate to one side of upper waveguide 204. Similarly, proximal end 380(2) of T-shaped choke structure 376(2) may interface with and/or be positioned against the opposing side of upper waveguide 204.

In one example, distal ends 378(1) and 378(2) of T-shaped choke structure 376(1) may be configured to oppose each other atop proximal end 380(1) such that distal ends 378(1) and 378(2) remain and/or are positioned away or distal from upper waveguide 204. Similarly, distal ends 378(3) and 378(4) of T-shaped choke structure 376(2) may be configured to oppose each other atop proximal end 380(2) such that distal ends 378(3) and 378(4) remain and/or are positioned away or distal from upper waveguide 204.

In one example, the lengths of T-shaped choke structures 376(1) and 376(2) as measured from the corresponding proximal end to either distal end may each be substantially equal to a quarter wavelength of the RF signals multiplied by an odd number. For example, if antenna 100 in FIG. 1 transmits and/or receives 10-Ghz signals, the length of T-shaped choke structure 376(1) may measure 7.5 mm from proximal end 380(1) to either distal end 378(1) or distal end 378(2). In another example, if antenna 100 in FIG. 1 transmits and/or receives 20-Ghz signals, the length of T-shaped choke structure 376(2) may measure 3.7 mm from proximal end 380(2) to either distal end 378(3) or distal end 378(4).

In some examples, one or more of distal ends 378(1)-(4) may be enclosed with a metallic wall and/or side. In other examples, one or more of distal ends 378(1)-(4) may be open without any walls and/or sides. In one example, T-shaped choke structures 376(1) and 376(2) may serve as the gap between the PCB array holding clamp and the bottom RF guide plate of antenna 100 in FIG. 1.

Figure 4:
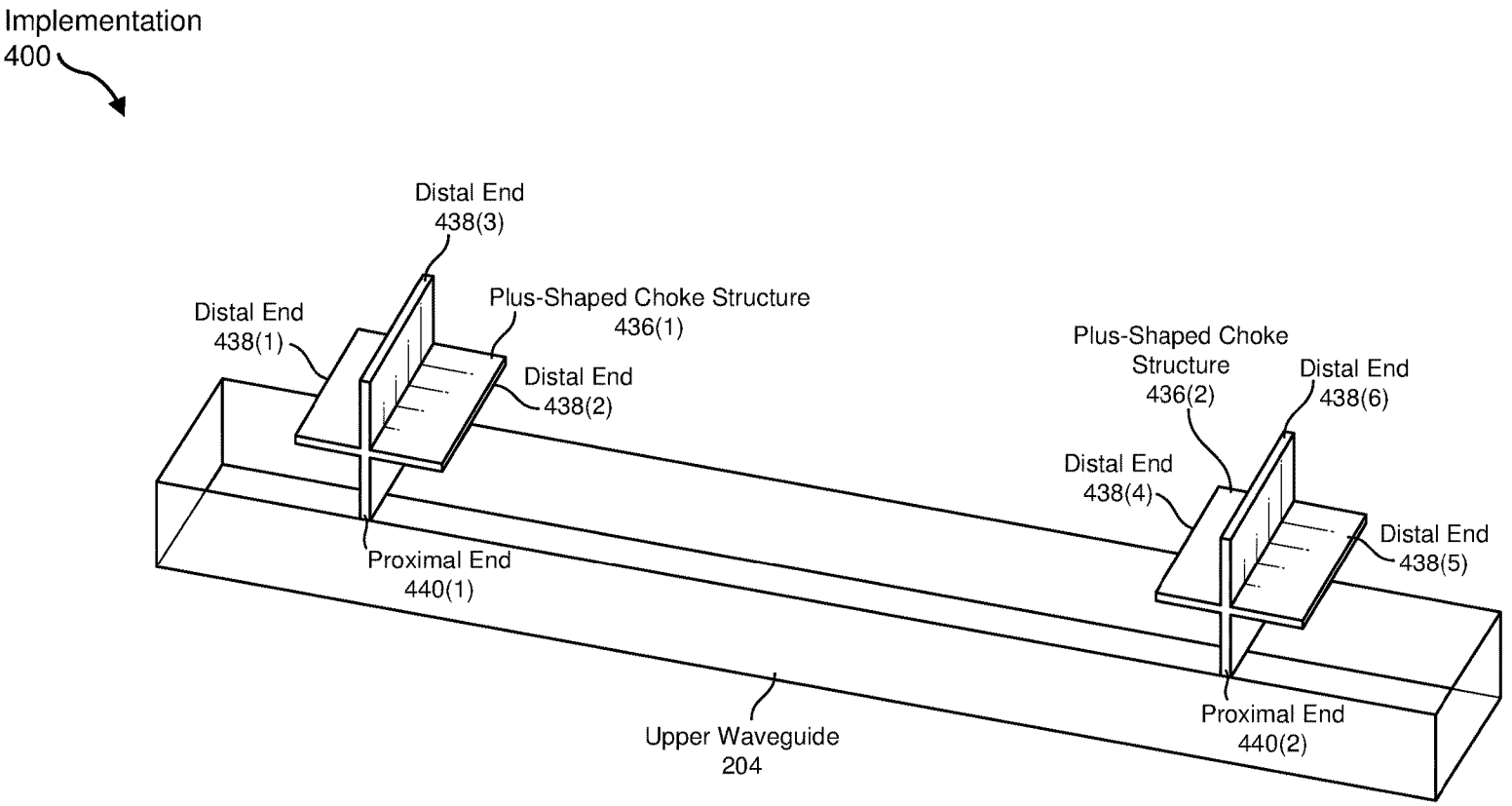
FIG. 4 is an illustration of an additional exemplary implementation for preventing RF energy leaks and intrusions via choke structures in accordance with one or more embodiments of this disclosure.

FIG. 4 illustrates an exemplary implementation 400 that facilitates preventing RF energy leaks and/or intrusions via choke structures. As illustrated in FIG. 4, exemplary implementation 400 may include and/or involve plus-shaped choke structures 436(1) and 436(2). In some examples, plus-shaped choke structures 436(1) and 436(2) may be coupled and/or attached to top array plate 104 such that plus-shaped choke structures 436(1) and 436(2) are positioned against and/or aligned with upper waveguide 204. In one example, plus-shaped choke structure 436(1) may include and/or represent a proximal end 440(1) that is fixed orthogonally between distal ends 438(1) and 438(2) and/or is fixed opposite distal end 438(3). Additionally or alternatively, plus-shaped choke structure 436(2) may include and/or represent a proximal end 440(2) that is fixed orthogonally between distal ends 438(4) and 438(5) and/or is fixed opposite distal end 438(6).

In one example, proximal end 440(1) of plus-shaped choke structure 436(1) may interface with and/or be positioned against or proximate to one side of upper waveguide 204. Similarly, proximal end 440(2) of plus-shaped choke structure 436(2) may interface with and/or be positioned against the opposing side of upper waveguide 204.

In one example, distal ends 438(1) and 438(2) of plus-shaped choke structure 436(1) may be configured to oppose each other atop proximal end 440(1), and distal end 438(3) of plus-shaped choke structure 436(1) may be configured to oppose and/or mirror proximal end 440(1) across distal ends 438(1) and 438(2). In this example, distal ends 438(1)-(3) may remain and/or be positioned away or distal from upper waveguide 204. Similarly, distal ends 438(4) and 438(5) of plus-shaped choke structure 436(2) may be configured to oppose each other atop proximal end 440(2), and distal end 438(6) of plus-shaped choke structure 436(2) may be configured to oppose and/or mirror proximal end 440(2) across distal ends 438(4) and 438(5). In this example, distal ends 438(4)-(6) may remain and/or be positioned away or distal from upper waveguide 204.

In one example, the lengths of plus-shaped choke structures 436(1) and 436(2) as measured from the corresponding proximal end to any distal end may each be substantially equal to a quarter wavelength of the RF signals multiplied by an odd number. For example, if antenna 100 in FIG. 1 transmits and/or receives 10-Ghz signals, the length of plus-shaped choke structure 436(1) may measure 7.5 mm from proximal end 440(1) to any of distal ends 438(1)-(3). In another example, if antenna 100 in FIG. 1 transmits and/or receives 20-Ghz signals, the length of plus-shaped choke structure 436(2) may measure 3.7 mm from proximal end 440(1) to any of distal ends 438(4)-(6).

In some examples, one or more of distal ends 438 (1)-(6) may be enclosed with a metallic wall and/or side. In other examples, one or more of distal ends 438 (1)-(6) may be open without any walls and/or sides. In one example, plus-shaped choke structures 436(1) and 436(2) may serve as the gap between the PCB array holding clamp and the bottom RF guide plate of antenna 100 in FIG. 1.

Figure 5:
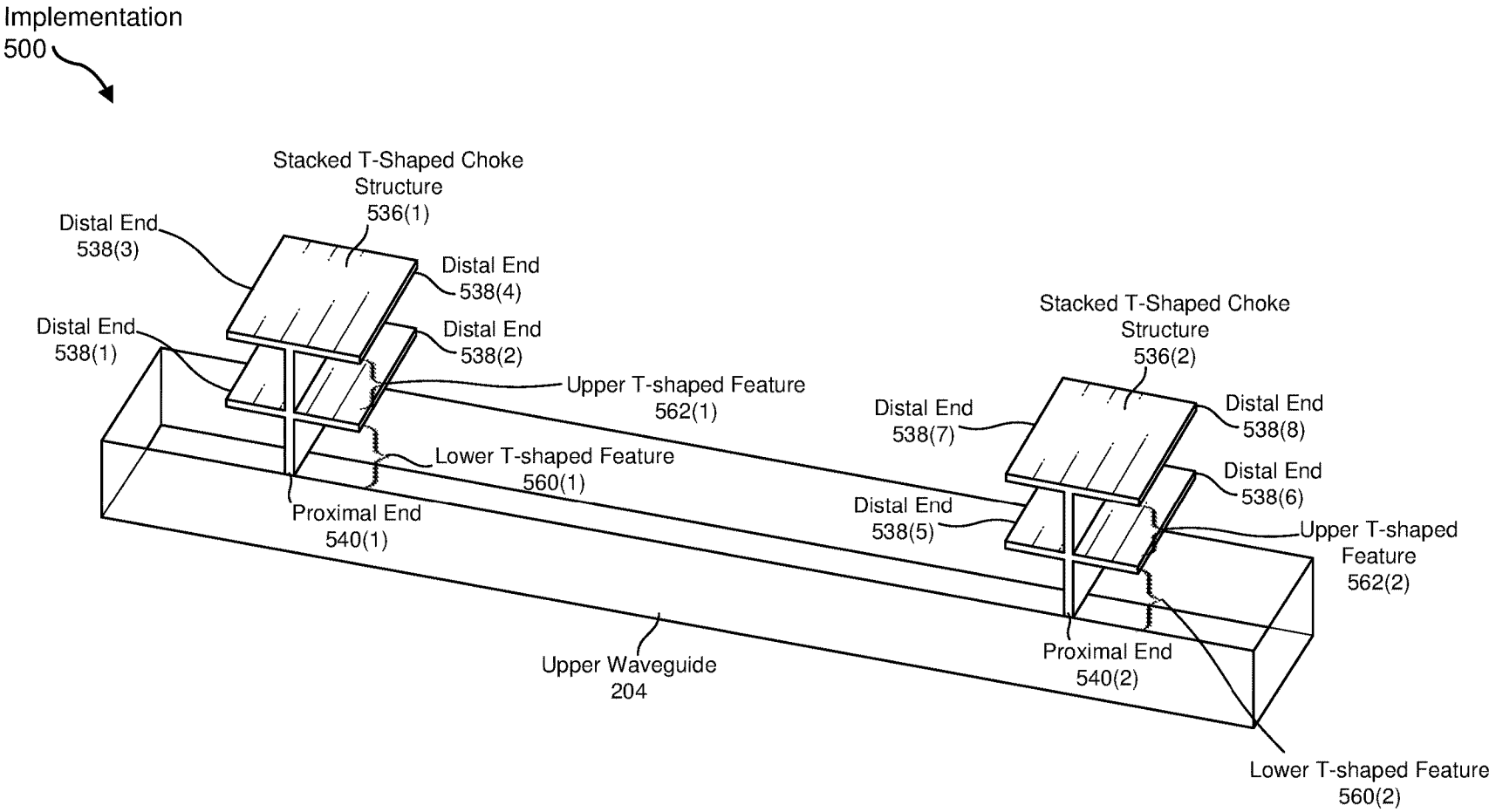
FIG. 5 is an illustration of an additional exemplary implementation for preventing RF energy leaks and intrusions via choke structures in accordance with one or more embodiments of this disclosure.

FIG. 5 illustrates an exemplary implementation 500 that facilitates preventing RF energy leaks and/or intrusions via choke structures. As illustrated in FIG. 5, exemplary implementation 500 may include and/or involve stacked T-shaped choke structures 536(1) and 536(2). In some examples, stacked T-shaped choke structures 536(1) and 536(2) may be coupled and/or attached to top array plate 104 such that stacked T-shaped choke structures 536(1) and 536(2) are positioned against and/or aligned with upper waveguide 204. In one example, each stacked T-shaped choke structure may include a lower T-shaped feature and an upper T-shaped feature. In this example, the lower T-shaped feature may interface with and/or be positioned against or proximate to one side of upper waveguide 204. The upper T-shaped feature may reside and/or be positioned atop the lower T-shaped feature in a stacked configuration and/or arrangement.

In one example, stacked T-shaped choke structure 536(1) may include and/or represent a proximal end 540(1) that is fixed orthogonally between distal ends 538(1) and 538(2) in a lower T-shaped feature 560(1). In this example, lower T-shaped feature 560(1) may include and/or represent the combination and/or configuration of proximal end 540(1) and distal ends 538(1) and 538(2). Additionally or alternatively, stacked T-shaped choke structure 536(1) may include and/or represent an intermediary segment positioned atop proximal end 540(1) such that the intermediary segment opposes and/or mirrors proximal end 540(1) across distal ends 538(1) and 538(2). Finally, stacked T-shaped choke structure 536(1) may include and/or represent distal ends 538(3) and 538(4) that are fixed orthogonally to the intermediary segment in an upper T-shaped feature 562(1). Accordingly, upper T-shaped feature 562(1) may include and/or represent the combination and/or configuration of the intermediary segment and distal ends 538(3) and 538(4).

In one example, distal ends 538(1) and 538(2) of T-shaped choke structure 536(1) may be configured to oppose each other atop proximal end 540(1) such that distal ends 538(1) and 538(2) remain and/or are positioned away or distal from upper waveguide 204. In this example, distal ends 538(3) and 538(4) of T-shaped choke structure 536(1) may be configured to oppose each other atop the intermediary segment such that distal ends 538(3) and 538(4) remain and/or are positioned even further away or even more distal from upper waveguide 204.

In one example, stacked T-shaped choke structure 536(2) may include and/or represent a proximal end 540(2) that is fixed orthogonally between distal ends 538(5) and 538(6) in a lower T-shaped feature 560(2). In this example, lower T-shaped feature 560(2) may include and/or represent the combination and/or configuration of proximal end 540(2) and distal ends 538(5) and 538(6). Additionally or alternatively, stacked T-shaped choke structure 536(2) may include and/or represent an intermediary segment positioned atop proximal end 540(2) such that the intermediary segment opposes and/or mirrors proximal end 540(2) across distal ends 538(5) and 538(6). Finally, stacked T-shaped choke structure 536(2) may include and/or represent distal ends 538(7) and 538(8) that are fixed orthogonally to the intermediary segment in an upper T-shaped feature 562(2). Accordingly, upper T-shaped feature 562(2) may include and/or represent the combination and/or configuration of the intermediary segment and distal ends 538(7) and 538(8).

In one example, distal ends 538(5) and 538(6) of T-shaped choke structure 536(2) may be configured to oppose each other atop proximal end 540(2) such that distal ends 538(5) and 538(6) remain and/or are positioned away or distal from upper waveguide 204. In this example, distal ends 538(7) and 538(8) of T-shaped choke structure 536(2) may be configured to oppose each other atop the intermediary segment such that distal ends 538(7) and 538(8) remain and/or are positioned even further away or even more distal from upper waveguide 204.

In one example, the lengths of stacked T-shaped choke structures 536(1) and 536(2) as measured from the corresponding proximal end to one distal end may be substantially equal to a quarter wavelength of the RF signals multiplied by an odd number. For example, if antenna 100 in FIG. 1 transmits and/or receives 10-Ghz signals, the length of stacked T-shaped choke structure 536(1) may measure 7.5 mm from proximal end 540(1) to either distal end 538(1) or distal end 538(2). In another example, if antenna 100 in FIG. 1 transmits and/or receives 20-Ghz signals, the length of stacked T-shaped choke structure 536(2) may measure 3.7 mm from proximal end 540(2) to either distal end 538(5) or distal end 538(6). In an additional example, if antenna 100 in FIG. 1 transmits and/or receives 10-Ghz signals, the length of stacked T-shaped choke structure 536(1) may measure 7.5 mm from proximal end 540(1) to either distal end 538(3) or distal end 538(4). In another example, if antenna 100 in FIG. 1 transmits and/or receives 20-Ghz signals, the length of stacked T-shaped choke structure 536(2) may measure 3.7 mm from proximal end 540(2) to either distal end 538(7) or distal end 538(8).

In some examples, one or more of distal ends 538(1)-(8) may be enclosed with a metallic wall and/or side. In other examples, one or more of distal ends 538(1)-(8) may be open without any walls and/or sides. In one example, stacked T-shaped choke structures 536(1) and 536(2) may serve as the gap between the PCB array holding clamp and the bottom RF guide plate of antenna 100 in FIG. 1.

Figure 6:
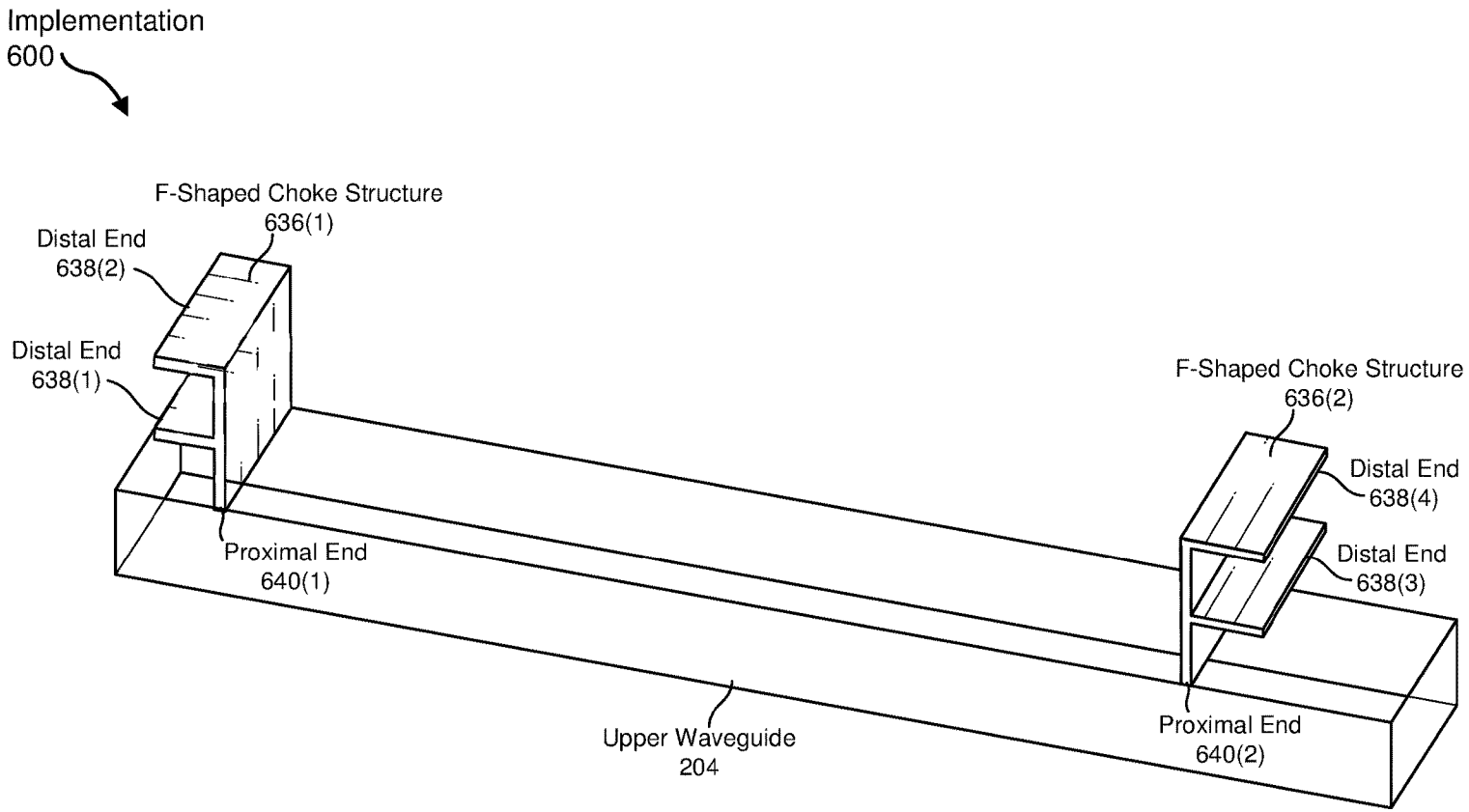
FIG. 6 is an illustration of an additional exemplary implementation for preventing RF energy leaks and intrusions via choke structures in accordance with one or more embodiments of this disclosure.

FIG. 6 illustrates an exemplary implementation 600 that facilitates preventing RF energy leaks and/or intrusions via choke structures. As illustrated in FIG. 6, exemplary implementation 600 may include and/or involve F-shaped choke structures 636(1) and 636(2). In some examples, F-shaped choke structures 636(1) and 636(2) may be coupled and/or attached to top array plate 104 such that F-shaped choke structures 636(1) and 636(2) are positioned against and/or aligned with upper waveguide 204. In one example, each F-shaped choke structure may include a lower-tier (e.g., L-shaped) feature and an upper-tier (e.g., another L-shaped) feature. In this example, the lower-tier feature may interface with and/or be positioned against or proximate to one side of upper waveguide 204. The upper-tier feature may reside and/or be positioned atop the lower-tier feature in a stacked configuration and/or arrangement that forms an "F" shape.

In one example, F-shaped choke structure 636(1) may include and/or represent a proximal end 640(1) that is fixed orthogonally to distal end 638(1) in a lower-tier feature. In this example, the lower-tier feature of F-shaped choke structure 636(1) may include and/or represent the combination and/or configuration of proximal end 640(1) and distal end 638(1). Additionally or alternatively, F-shaped choke structure 636(1) may include and/or represent an intermediary segment positioned atop proximal end 640(1) such that the intermediary segment opposes and/or mirrors proximal end 640(1) across distal end 638(1). Finally, F-shaped choke structure 636(1) may include and/or represent distal end 638(2) that is fixed orthogonally to the intermediary segment in an upper T-shaped feature. Accordingly, the upper T-shaped feature of F-shaped choke structure 636(1) may include and/or represent the combination and/or configuration of the intermediary segment and distal end 638(2).

In one example, F-shaped choke structure 636(2) may include and/or represent a proximal end 640(2) that is fixed orthogonally to distal end 638(3) in a lower-tier feature. In this example, the lower-tier feature of F-shaped choke structure 636(2) may include and/or represent the combination and/or configuration of proximal end 640(2) and distal end 638(3). Additionally or alternatively, F-shaped choke structure 636(2) may include and/or represent an intermediary segment positioned atop proximal end 640(2) such that the intermediary segment opposes and/or mirrors proximal end 640(2) across distal end 638(3). Finally, F-shaped choke structure 636(2) may include and/or represent distal end 638(4) that is fixed orthogonally to the intermediary segment in an upper T-shaped feature. Accordingly, the upper T-shaped feature of F-shaped choke structure 636(2) may include and/or represent the combination and/or configuration of the intermediary segment and distal end 638(4).

In one example, the lengths of F-shaped choke structures 636(1) and 636(2) as measured from the corresponding proximal end to one distal end may be substantially equal to a quarter wavelength of the RF signals multiplied by an odd number. For example, if antenna 100 in FIG. 1 transmits and/or receives 10-Ghz signals, the length of F-shaped choke structure 536(1) may measure 7.5 mm from proximal end 640(1) to either distal end 638(1) or distal end 638(2). In another example, if antenna 100 in FIG. 1 transmits and/or receives 20-Ghz signals, the length of F-shaped choke structure 636(2) may measure 3.7 mm from proximal end 640(2) to either distal end 638(3) or distal end 638(4).

In some examples, one or more of distal ends 638(1)-(4) may be enclosed with a metallic wall and/or side. In other examples, one or more of distal ends 638(1)-(4) may be open without any walls and/or sides. In one example, F-shaped choke structures 636(1) and 636(2) may serve as the gap between the PCB array holding clamp and the bottom RF guide plate of antenna 100 in FIG. 1.

Figure 7:
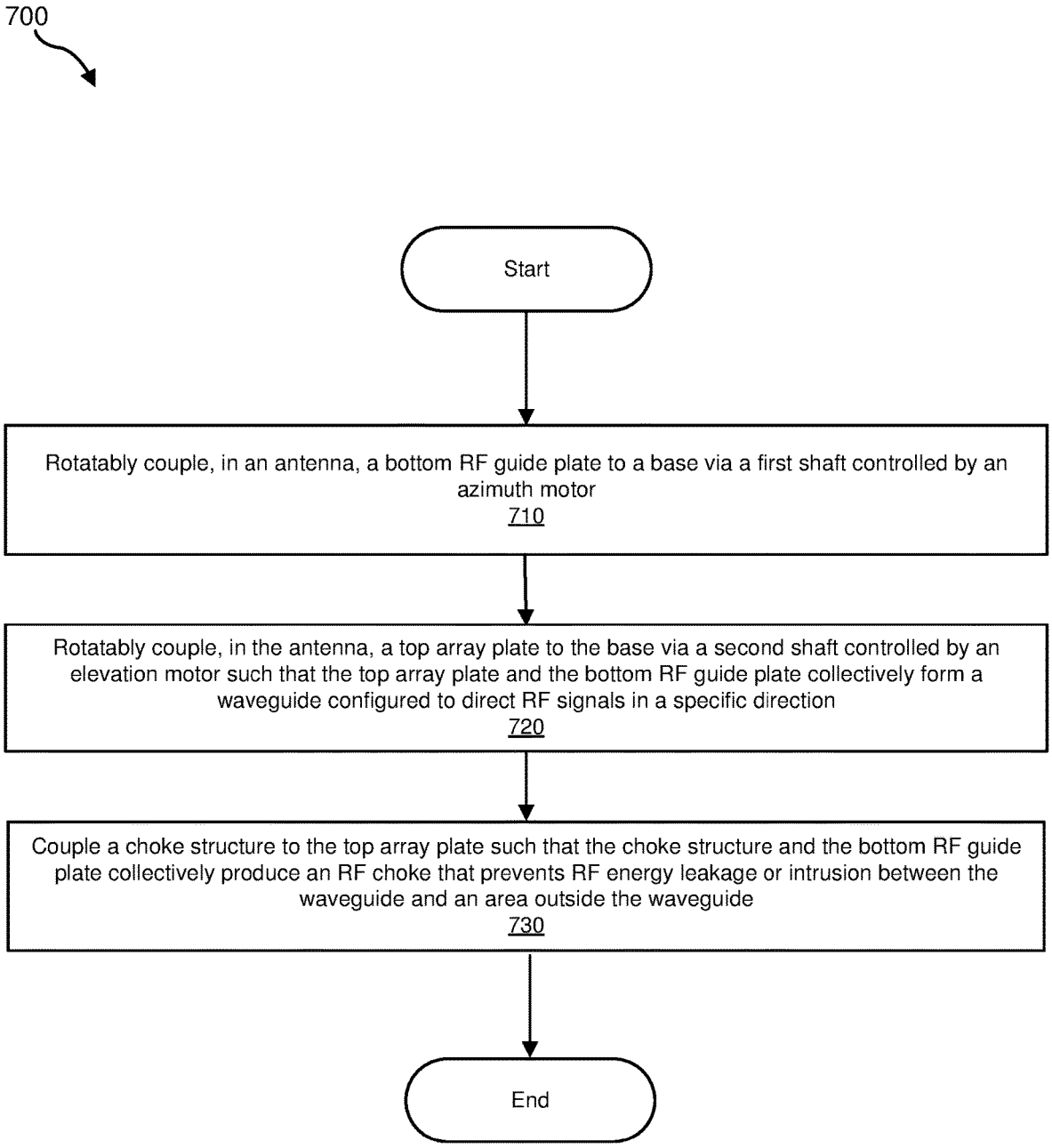
FIG. 7 is a flow diagram of an exemplary method of assembling an apparatus for preventing RF energy leaks and intrusions via choke structures according to one or more embodiments of this disclosure.

FIG. 7 is a flow diagram of an exemplary method 700 for facilitating the prevention of RF energy leaks and/or intrusions via choke structures. Method 700 may include the step of rotatably couple, in an antenna, a bottom RF guide plate to a base via a first shaft controlled by an azimuth motor (710). Step 710 may be performed in a variety of ways, including any of those described above in connection with FIGS. 1-6. For example, a communications equipment vendor or subcontractor may rotatably couple, in an antenna, a bottom RF guide plate to a base via a first shaft controlled by an azimuth motor. Additionally or alternatively, an antenna fabrication system may rotatably couple, in an antenna, a bottom RF guide plate to a base via a first shaft controlled by an azimuth motor.

Method 700 may also include the step of rotatably couple, in an antenna, a top array plate to the base via a second shaft controlled by an elevation motor such that the top array plate and the bottom RF guide plate collectively form a waveguide configured to direct RF signals in a specific direction (720). Step 720 may be performed in a variety of ways, including any of those described above in connection with FIGS. 1-6. For example, the communications equipment vendor or subcontractor may rotatably couple, in an antenna, a top array plate to the base via a second shaft controlled by an elevation motor such that the top array plate and the bottom RF guide plate collectively form a waveguide configured to direct RF signals in a specific direction. Additionally or alternatively, the antenna fabrication system may rotatably couple, in an antenna, a top array plate to the base via a second shaft controlled by an elevation motor such that the top array plate and the bottom RF guide plate collectively form a waveguide configured to direct RF signals in a specific direction.

Method 700 may further include the step of coupling a choke structure to the top array plate such that the choke structure and the bottom RF guide plate collectively produce and an RF choke that prevents RF energy leakage or intrusion between the waveguide and an area outside the waveguide (730). Step 730 may be performed in a variety of ways, including any of those described above in connection with FIGS. 1-6. For example, the communications equipment vendor or subcontractor may couple a choke structure to the top array plate such that the choke structure and the bottom RF guide plate collectively produce and an RF choke that prevents RF energy leakage or intrusion between the waveguide and an area outside the waveguide. Additionally or alternatively, the antenna fabrication system may couple a choke structure to the top array plate such that the choke structure and the bottom RF guide plate collectively produce and an RF choke that prevents RF energy leakage or intrusion between the waveguide and an area outside the waveguide.

Example Embodiments

Example 1: An antenna comprising (1) a bottom RF guide plate rotatably coupled to a base via a first shaft controlled by an azimuth motor, (2) a top array plate rotatably coupled to the base via a second shaft controlled by an elevation motor, the top array plate and the bottom RF guide plate collectively forming a waveguide configured to direct RF signals in a specific direction, and (3) a choke structure coupled to the top array plate, the choke structure and the bottom RF guide plate collectively producing a RF choke that mitigates RF energy leakage or intrusion between the waveguide and an area outside the waveguide.

Example 2: The antenna of Example 1, wherein the choke structure comprises an L-shaped choke structure coupled to the top array plate.

Example 3: The antenna of either of Examples 1 and 2, wherein a length of the L-shaped choke structure is substantially equal to a quarter wavelength of the RF signals multiplied by an odd number.

Example 4: The antenna of any of Examples 1-3, wherein the choke structure comprises a T-shaped choke structure coupled to the top array plate.

Example 5: The antenna of any of Examples 1-4, wherein a length of the T-shaped choke structure as measured from the waveguide to either distal end of the T-shaped choke structure is substantially equal to a quarter wavelength of the RF signals multiplied by an odd number.

Example 6: The antenna of any of Examples 1-5, wherein the choke structure comprises a plus-shaped choke structure coupled to the top array plate.

Example 7: The antenna of any of Examples 1-6, wherein a length of the plus-shaped choke structure as measured from the waveguide to each distal end of the plus-shaped choke structure is substantially equal to a quarter wavelength of the RF signals multiplied by an odd number.

Example 8: The antenna of any of Examples 1-7, wherein the choke structure comprises a stacked T-shaped choke structure coupled to the top array plate.

Example 9: The antenna of any of Examples 1-8, wherein a length of a lower T-shaped feature included in the stacked T-shaped choke structure as measured from the waveguide to either distal end of the lower T-shaped feature is substantially equal to a quarter wavelength of the RF signals multiplied by an odd number.

Example 10: The antenna of any of Examples 1-9, wherein the choke structure comprises an F-shaped choke structure coupled to the top array plate.

Example 11: The antenna of any of Examples 1-10, wherein a length of a lower-tier feature included in the F-shaped choke structure as measured from the waveguide to a distal end of a lower-tier feature is substantially equal to a quarter wavelength of the RF signals multiplied by an odd number.

Example 12: The antenna of any of Examples 1-11, wherein the choke structure comprises (1) at least one proximal end positioned proximate to the waveguide and (2) at least one distal end positioned distal from the waveguide.

Example 13: The antenna of any of Examples 1-12, wherein the distal end of the choke structure is enclosed with a metallic wall.

Example 14: The antenna of any of Examples 1-13, wherein the distal end of the choke structure includes an opening.

Example 15: A system comprising (1) a satellite and (2) a steerable antenna wirelessly coupled to the satellite, wherein the steerable antenna comprises (A) a bottom RF guide plate rotatably coupled to a base via a first shaft controlled by an azimuth motor, (B) a top array plate rotatably coupled to a base via a second shaft controlled by an elevation motor, the top array plate and the bottom RF guide plate collectively forming a waveguide configured to direct RF signals in a specific direction, and (C) a choke structure coupled to the top array plate, the choke structure and the bottom RF guide plate collectively producing a RF choke that mitigates RF energy leakage or intrusion between the waveguide and an area outside the waveguide.

Example 16: The system of Example 15, wherein the choke structure comprises an L-shaped choke structure coupled to the top array plate.

Example 17: The system of either of Examples 15 and 16, wherein a length of the L-shaped choke structure is substantially equal to a quarter wavelength of the RF signals multiplied by an odd number.

Example 18: The system of any of Examples 15-17, wherein the choke structure comprises a T-shaped choke structure coupled to the top array plate.

Example 19: The system of any of Examples 15-18, wherein a length of the T-shaped choke structure as measured from the waveguide to either distal end of the T-shaped choke structure is substantially equal to a quarter wavelength of the RF signals multiplied by an odd number.

Example 20: A method may comprise (1) rotatably coupling, in an antenna, a bottom RF guide plate to a base via a first shaft controlled by an azimuth motor, (2) rotatably coupling, in the antenna, a top array plate to the base via a second shaft controlled by an elevation motor such that the top array plate and the bottom RF guide plate collectively form a waveguide configured to direct RF signals in a specific direction, and (3) coupling a choke structure to the top array plate such that the choke structure and the bottom RF guide plate collectively produce a RF choke that mitigates RF energy leakage or intrusion between the waveguide and an area outside the waveguide.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to any claims appended hereto and their equivalents in determining the scope of the present disclosure.

Unless otherwise noted, the terms "connected to" and "coupled to" (and their derivatives), as used in the specification and/or claims, are to be construed as permitting both direct and indirect (i.e., via other elements or components) connection. In addition, the terms "a" or "an," as used in the specification and/or claims, are to be construed as meaning "at least one of." Finally, for ease of use, the terms "including" and "having" (and their derivatives), as used in the specification and/or claims, are interchangeable with and have the same meaning as the word "comprising."

What is claimed is:

1. An antenna comprising:

a bottom Radio Frequency (RF) guide plate rotatably coupled to a base via a first shaft controlled by an azimuth motor;

a top array plate rotatably coupled to the base via a second shaft controlled by an elevation motor, the top array plate and the bottom RF guide plate collectively forming a waveguide configured to direct RF signals in a specific direction; and a choke structure coupled to the top array plate, the choke structure and the bottom RF guide plate collectively producing a RF choke that mitigates RF energy leakage or intrusion between the waveguide and an area outside the waveguide.

2. The antenna of claim 1, wherein the choke structure comprises an L-shaped choke structure coupled to the top array plate.

3. The antenna of claim 2, wherein a length of the L-shaped choke structure is substantially equal to a quarter wavelength of the RF signals multiplied by an odd number.

4. The antenna of claim 1, wherein the choke structure comprises a T-shaped choke structure coupled to the top array plate.

5. The antenna of claim 4, wherein a length of the T-shaped choke structure as measured from the waveguide to either distal end of the T-shaped choke structure is substantially equal to a quarter wavelength of the RF signals multiplied by an odd number.

6. The antenna of claim 1, wherein the choke structure comprises a plus-shaped choke structure coupled to the top array plate.

7. The antenna of claim 6, wherein a length of the plus-shaped choke structure as measured from the waveguide to each distal end of the plus-shaped choke structure is substantially equal to a quarter wavelength of the RF signals multiplied by an odd number.

8. The antenna of claim 1, wherein the choke structure comprises a stacked T-shaped choke structure coupled to the top array plate.

9. The antenna of claim 8, wherein a length of a lower T-shaped feature included in the stacked T-shaped choke structure as measured from the waveguide to either distal end of the lower T-shaped feature is substantially equal to a quarter wavelength of the RF signals multiplied by an odd number.

10. The antenna of claim 1, wherein the choke structure comprises an F-shaped choke structure coupled to the top array plate.

11. The antenna of claim 10, wherein a length of a lower-tier feature included in the F-shaped choke structure as measured from the waveguide to a distal end of the lower-tier feature is substantially equal to a quarter wavelength of the RF signals multiplied by an odd number.

12. The antenna of claim 1, wherein the choke structure comprises:

at least one proximal end positioned proximate to the waveguide; and at least one distal end positioned distal from the waveguide.

13. The antenna of claim 12, wherein the distal end of the choke structure is enclosed with a metallic wall.

14. The antenna of claim 12, wherein the distal end of the choke structure includes an opening.

15. A system comprising:

a satellite; and a steerable antenna wirelessly coupled to the satellite, wherein the steerable antenna comprises:

a bottom Radio Frequency (RF) guide plate rotatably coupled to a base via a first shaft controlled by an azimuth motor;

a top array plate rotatably coupled to the base via a second shaft controlled by an elevation motor, the top array plate and the bottom RF guide plate collectively forming a waveguide configured to direct RF signals in a specific direction; and a choke structure coupled to the top array plate, the choke structure and the bottom RF guide plate collectively producing a RF choke that mitigates RF energy leakage or intrusion between the waveguide and an area outside the waveguide.

16. The system of claim 15, wherein the choke structure comprises an L-shaped choke structure coupled to the top array plate.

17. The system of claim 16, wherein a length of the L-shaped choke structure is substantially equal to a quarter wavelength of the RF signals multiplied by an odd number.

18. The system of claim 15, wherein the choke structure comprises a T-shaped choke structure coupled to the top array plate.

19. The system of claim 18, wherein a length of the T-shaped choke structure as measured from the waveguide to either distal end of the T-shaped choke structure is substantially equal to a quarter wavelength of the RF signals multiplied by an odd number.

20. A method comprising:

rotatably coupling, in an antenna, a bottom radio frequency (RF) guide plate to a base via a first shaft controlled by an azimuth motor;

rotatably coupling, in the antenna, a top array plate to the base via a second shaft controlled by an elevation motor such that the top array plate and the bottom RF guide plate collectively form a waveguide configured to direct RF signals in a specific direction; and coupling a choke structure to the top array plate such that the choke structure and the bottom RF guide plate collectively produce a RF choke that mitigates RF energy leakage or intrusion between the waveguide and an area outside the waveguide.

* * * * *